US006762383B2

(12) United States Patent
Morito

(10) Patent No.: US 6,762,383 B2
(45) Date of Patent: Jul. 13, 2004

(54) SORTING SYSTEM

(75) Inventor: Hiroshi Morito, Tokyo (JP)

(73) Assignee: Leading Information Technology, Inc., Tokyo (JP)

( * ) Notice: Subject to any disclaimer, the term of this patent is extended or adjusted under 35 U.S.C. 154(b) by 0 days.

(21) Appl. No.: 10/271,520

(22) Filed: Oct. 15, 2002

(65) Prior Publication Data

US 2003/0116479 A1 Jun. 26, 2003

(30) Foreign Application Priority Data

Oct. 12, 2001 (JP) ..... 2001-314806

(51) Int. Cl.[7] ..... B07C 5/34

(52) U.S. Cl. ..... 209/583; 209/576; 209/552; 700/225; 700/226; 700/219

(58) Field of Search ..... 209/552, 576, 209/583; 700/221, 224, 223, 115, 214, 215, 216, 226

(56) References Cited

U.S. PATENT DOCUMENTS 3,955,680 A * 5/1976 Botula ..... 209/696
4,509,123 A * 4/1985 Vereen ..... 700/130
4,991,719 A * 2/1991 Butcher et al. ..... 209/3.3
5,500,800 A * 3/1996 Talbott ..... 700/99
5,757,661 A * 5/1998 Surville ..... 702/155
5,978,771 A * 11/1999 Vandivier, III ..... 705/8
6,181,981 B1 * 1/2001 Varga et al. ..... 700/236
6,289,260 B1 * 9/2001 Bradley et al. ..... 700/216
6,611,732 B2 * 8/2003 Okamura ..... 700/226
6,685,031 B2 * 2/2004 Takizawa ..... 209/546

* cited by examiner

*Primary Examiner*—Donald P. Walsh
*Assistant Examiner*—Jonathan R Miller

(57) ABSTRACT

Articles entered into a sorting system are identified by means of an article identification device 1. An allocation ratio is selected from an allocation ratio table 7 based on the identifying information from the article identification device 1. Chute selection information is obtained for a sorter 2 based on the allocation ratio by means of a calculator 6, which in one embodiment uses a random number generator 8 to make a weighted calculation and a deviation reduction mechanism 11 to reduce the deviation of the accumulated weighted calculation results. A controller 3 selects a chute 4 such that the articles entered into the system will be distributed in accordance with the article allocation ratio, and provides the chute selection information to the sorter 2. The sorter 2, based upon the chute selection information, conducts sorting by dropping the articles entered into the system into the appropriate chute 4.

7 Claims, 6 Drawing Sheets

SORTING SYSTEM

BACKGROUND

When selling apparel, shoes, handbags, wallets, and other merchandise, it is necessary to maintain a large number of sizes and colors for each type of item in order to sell merchandise that is appropriate to each season or the like. In situations where a size or a color is sold out or the merchandise is not appropriate for the season, the merchandise will be switched to a sales channel that is different from the normal sales channel and will be sold as special-event items and sale items.

In such a case, products either remain as unsold at individual stores, or remain as replenishment inventory at a distribution center or the like. Because these products are in various locations, they must all be collected to the distribution center first and then be re-sorted for use at special-event venues or discount stores. In addition, these products include a number of identical items. There will also be imbalances in size and color because of prior sales. Consequently, it will be necessary to correctly re-sort these products so that each product line or product group is properly allocated according to the special venues or discount stores.

FIG. 8 is a conceptual diagram of a conventional sorting system used for this type of sorting. The sorting system shown in FIG. 8 has an article identification device 1, a sorter 2 that has multiple chutes 4, and a controller 3. The controller 3 has an allocation count table from which an allocation count is selected based on the identification information from the article identification device 1, and a calculation means 6 that selects chutes of the sorter based upon the allocation count.

In a sorting system constructed in this manner, when an article to be sorted is entered into the system, a barcode or the like attached to the article is first read out by the article identification device 1 to identify the article that has been entered. Next, the article identification information is passed to the allocation count table 5. The allocation count table 5 provides one or more sorting destinations for each article group in the form of an associated allocation count for each chute 4, to the calculation means 6.

Based on this allocation count information, the calculation means 6 selects the chute 4 into which the article is to be dropped. Specifically, the calculation means 6 selects any of the chutes 4 whose cumulative allocation count for the article group associated with the article has not reached the allocation count provided by the allocation count table 5, and provides this information as chute selection information to the sorter 2. Finally, the sorter 2 drops the article into the selected chute 4, thereby completing a sorting operation.

When employing a sorting device constructed in this manner for sorting articles for special-event sale or special sale, the allocation counts cannot be determined unless the total number of articles to be sorted, i.e., the total number of articles in each article groups, is known. Therefore, all of the articles to be sorted must be received prior to sorting. In addition, in order to determine the total number of articles to be sorted, the articles must be sorted into article groups and the total number of articles in each group must be counted.

FIG. 9 is a flow chart that shows the sorting process when the conventional sorting system shown in FIG. 8 is employed. First, the articles are piled up and accumulated until they have all been delivered. Next, the articles are classified into groups, and the number of items is confirmed as the number of items delivered. When the confirmation of the number of items delivered is completed, the allocation counts for special-event venues and discount shops are determined according to the number of items delivered. The allocation counts are passed onto the conventional sorting system shown in FIG. 8, and sorting and allocation are performed. When the sorting is completed, the articles are shipped out.

However, the following problems exist in the conventional sorting system. The articles to be used for special-event sales and special sales are spread amongst stores, distribution centers, etc. Retail stores are spread across various areas, including remote areas. Because of this, the time it takes for the articles to be transferred will be different for each store. In many cases, waiting for all of the articles to be delivered in the sorting process shown in FIG. 9 causes the articles to accumulate for a long time. In addition, because there are normally small quantities of a large number of different items in each retail store, the unsold articles to be returned will also consist of small quantities of a large number of different items. Naturally, many different articles are sometimes returned in an indistinguishable mass.

Therefore, the step of sorting the incoming articles in the classification process shown in FIG. 9 is made quite cumbersome. Thus, the first problem with a conventional sorting system is that articles are accumulated for a long period of time because one must wait for all of the incoming articles to be delivered. The second problem is that the process of sorting the incoming articles is arduous.

SUMMARY

In one practical embodiment, the sorting system is provided with an article identification device, a sorter having multiple chutes, and a controller that controls the article identification device and the sorter, wherein the controller is provided with an allocation ratio table, selects an appropriate allocation ratio from the allocation ratio table based upon the identification information that is output by the article identification device, and calculates the chute selection information that is to be supplied to the sorter based upon the selected allocation ratio.

By constructing a sorting system in this manner, the sorting of incoming articles can be accomplished without waiting for all of the incoming articles to be received. Confirming the number of incoming articles is unnecessary, and the accumulation of articles can be eliminated. Moreover, since the incoming articles need not be accumulated, no storage space is needed and the number of incoming articles need not be confirmed, the work of sorting the incoming products and counting the number of incoming products is reduced.

In one embodiment a random number is processed with the ratio information to provide an appropriately weighted calculation of the chute selection information, and a deviation reduction mechanism reduces the deviation of the accumulated weighted calculation results.

BRIEF DESCRIPTION OF THE DRAWINGS

Certain specific embodiments of the present invention will now be described below with references to FIGS. 1 to 7 of the appended drawings, in which.

FIRST EMBODIMENT

The first embodiment of the present invention is a sorting system that identifies the articles returned from retail stores, selects an allocation ratio from an allocation ratio table, and sorts the articles as special-event sale articles or special sale articles using a sorter having multiple chutes.

Figure 1:
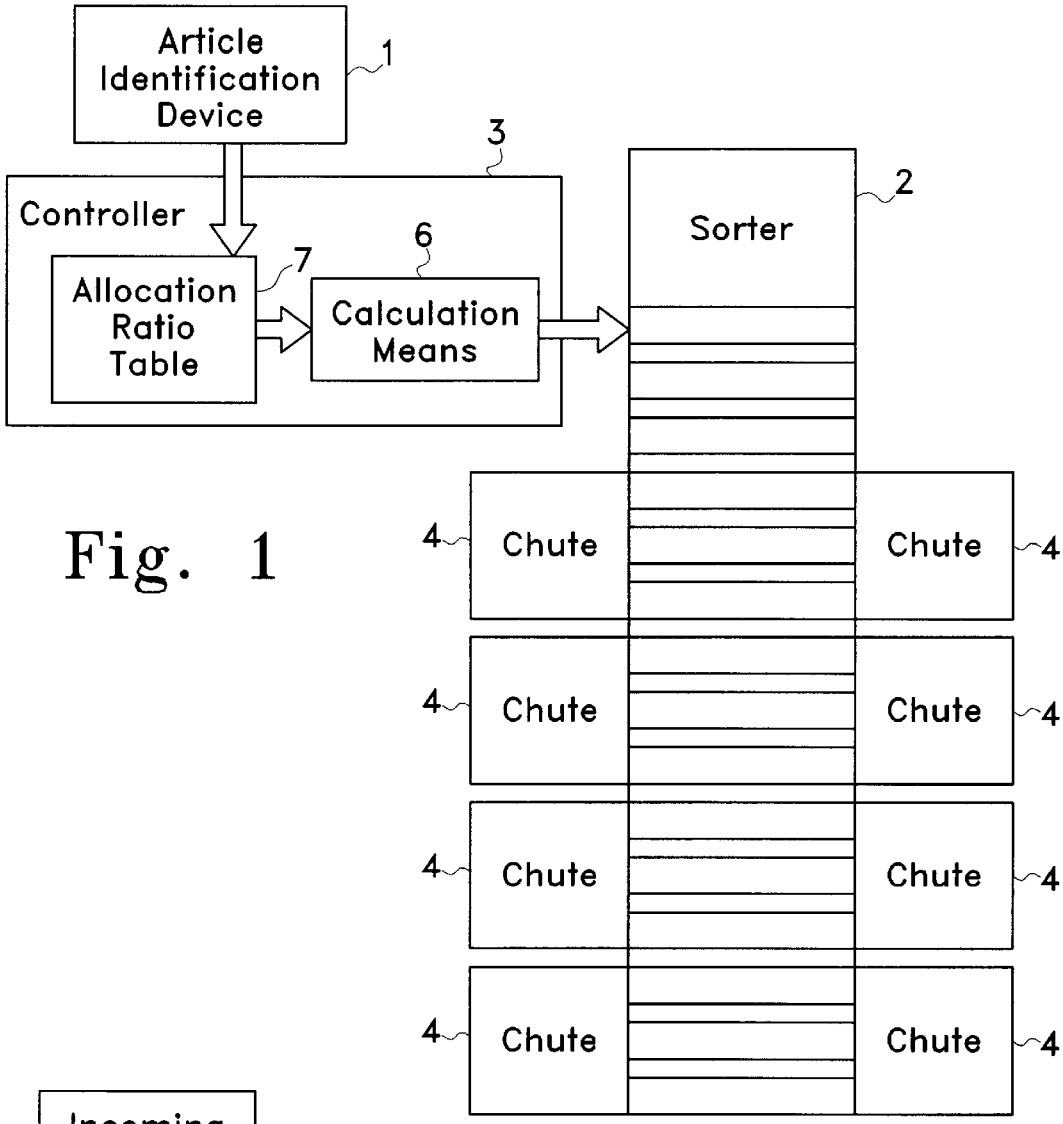
FIG. 1 is a conceptual diagram of a sorting system according to the first embodiment of the present invention.
Figure 2:
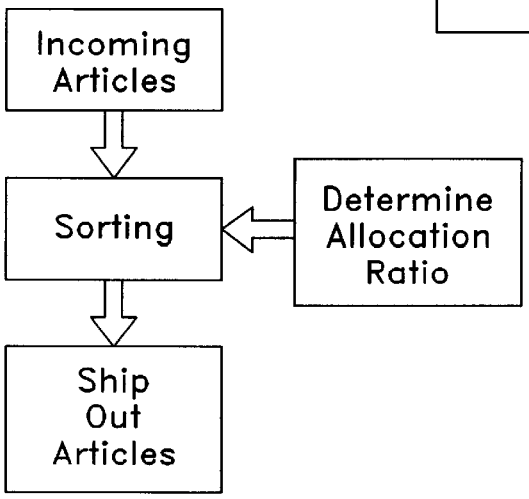
FIG. 2 is a figure showing the process of sorting that uses the sorting system according to the first embodiment of the present invention.

FIG. 1 is a conceptual view of the sorting system according to the first embodiment of the present invention; FIG. 2 shows an exemplary sorting process. In FIG. 1, an article identification device 1 is a means for identifying the article entered into the system. This article identification device 1 is capable of identifying the articles returned from retail stores, articles for special-event sales, and/or articles for special sales. A sorter 2 has multiple chutes 4, and sorts articles by dropping them into selected chutes 4. A controller 3 responsive to the article identification device 1 controls the sorter 2. A calculation means 6 calculates the information for selecting the chutes 4 of the sorter 2. An allocation ratio table 7 provides the allocation ratio based on the identification information from the article identification device 1.

The operation of the sorting system according to the first embodiment of the present invention constructed in the aforementioned manner will be described. As shown in FIG. 1, the sorting system has an article identification device 1, a sorter 2 having multiple chutes 4, and a controller 3. The controller 3 includes an allocation ratio table 7 and a calculation means 6. An article placed into the system is identified by the article identification system 1. This identification information is provided to the allocation ratio table 7 inside the controller 3. The allocation ratio table 7 provides one or more sorting destinations for each article group in the form of an associated allocation ratio defining the relative allocation for each chute 4, to the calculation means 6.

The associated allocation ratio data for a particular article are retrieved from the allocation ratio table 7 based on the article group information from the article identification device 1. Chute selection information is obtained by means of the calculation means 6 based upon the retrieved allocation ratio data. The controller 3 selects the chute 4 by means of the calculation means 6 such that the articles entered into the system are distributed according to the relative allocations for that article group. For example, if the ratio between chutes A and B for a given article group was x:y, chute A would be selected for x articles and chute B would be selected for y articles; whereupon the process would be repeated. The controller 3 provides the chute selection information to the sorter 2 and the sorter 2 drops the articles entered into the system into the applicable chute 4 based upon this chute selection information.

As the process in FIG. 2 shows, the delivered articles are sorted as they are received. In the sorting process, the articles are sorted based upon the predetermined allocation ratios for various article groups, and then the articles are shipped out. Arduous tasks, such as accumulating the articles until they have all been delivered, sorting incoming articles, and confirming the number of arriving articles, are eliminated.

Figure 8:
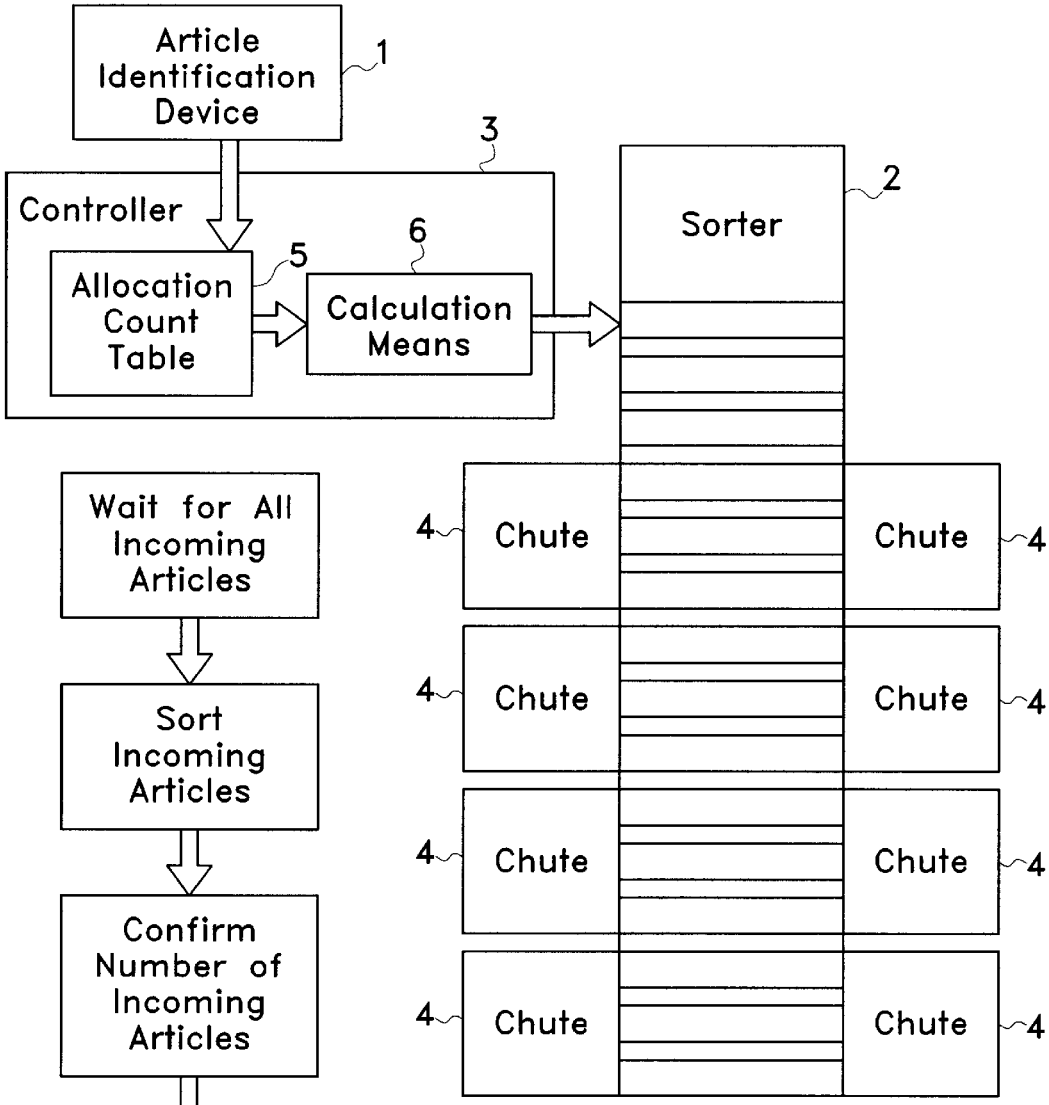
FIG. 8 is a conceptual diagram of a conventional sorting system.
Figure 9:
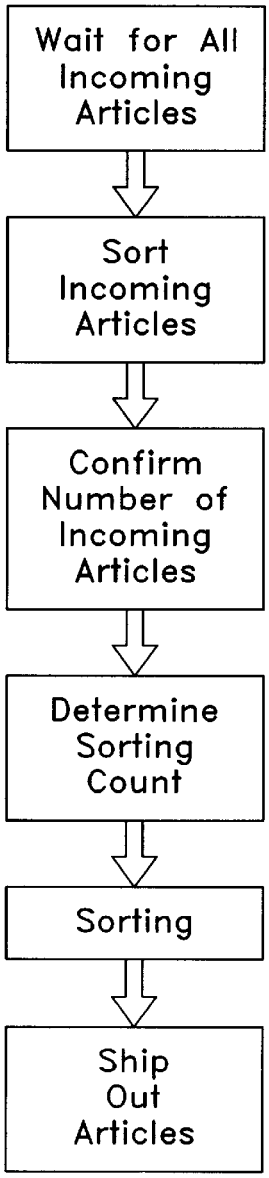
FIG. 9 is a flow chart showing the process of sorting employed in a conventional sorting system.

In the sorting system according to the first embodiment, because the allocation destination, i.e., the chute selection, is determined by the allocation ratio, neither the total number of articles to be allocated nor their population parameter is needed. The fact that no population parameter is needed means that the total number of incoming articles need not be determined. Thus, out of the steps used in the sorting process (FIG. 9) employed by the conventional sorting system shown in FIG. 8, three of them, i.e., waiting for all of the incoming articles to be delivered, sorting the incoming articles, and determining the number of incoming articles, are eliminated.

As described above, because the first embodiment of the present invention is constructed such that it identifies the articles returned from retail stores, selects the allocation ratio from the allocation ratio table, and sorts the articles as special-event sale articles or special sale articles with a sorter having multiple chutes, sorting can occur without determining the total number of incoming articles.

Second Embodiment

A second embodiment of the present invention identifies the articles returned from retail stores, selects an allocation ratio from an allocation ratio table, calculates the weights to be assigned to random numbers according to the allocation ratio, and based upon the results of this calculation, sorts special-event sale articles or special sale articles with a sorter having multiple chutes.

Figure 3:
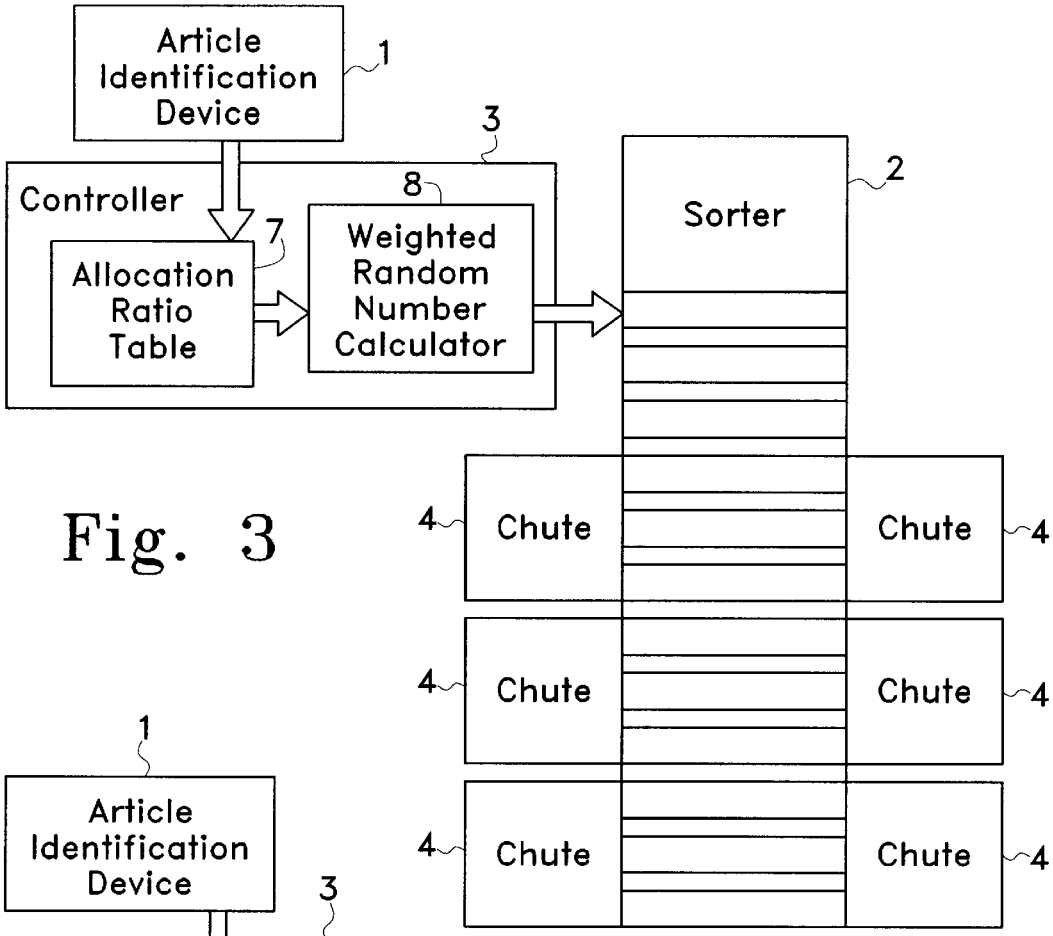
FIG. 3 is a conceptual diagram of the sorting system according to the second embodiment of the present invention.
Figure 4:
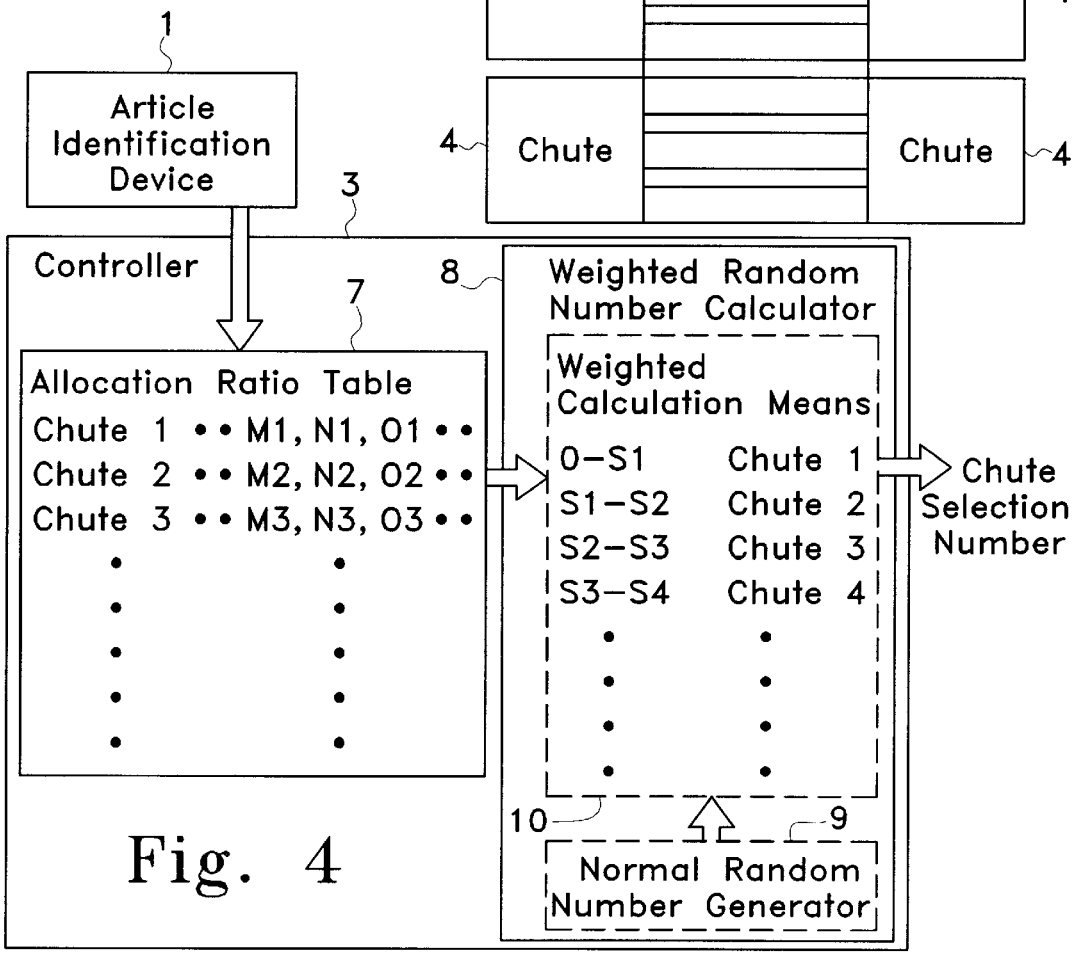
FIG. 4 is a conceptual diagram showing the article identification device employed in the sorting system according to the second embodiment of the present invention and the details of the controller.
Figure 5:
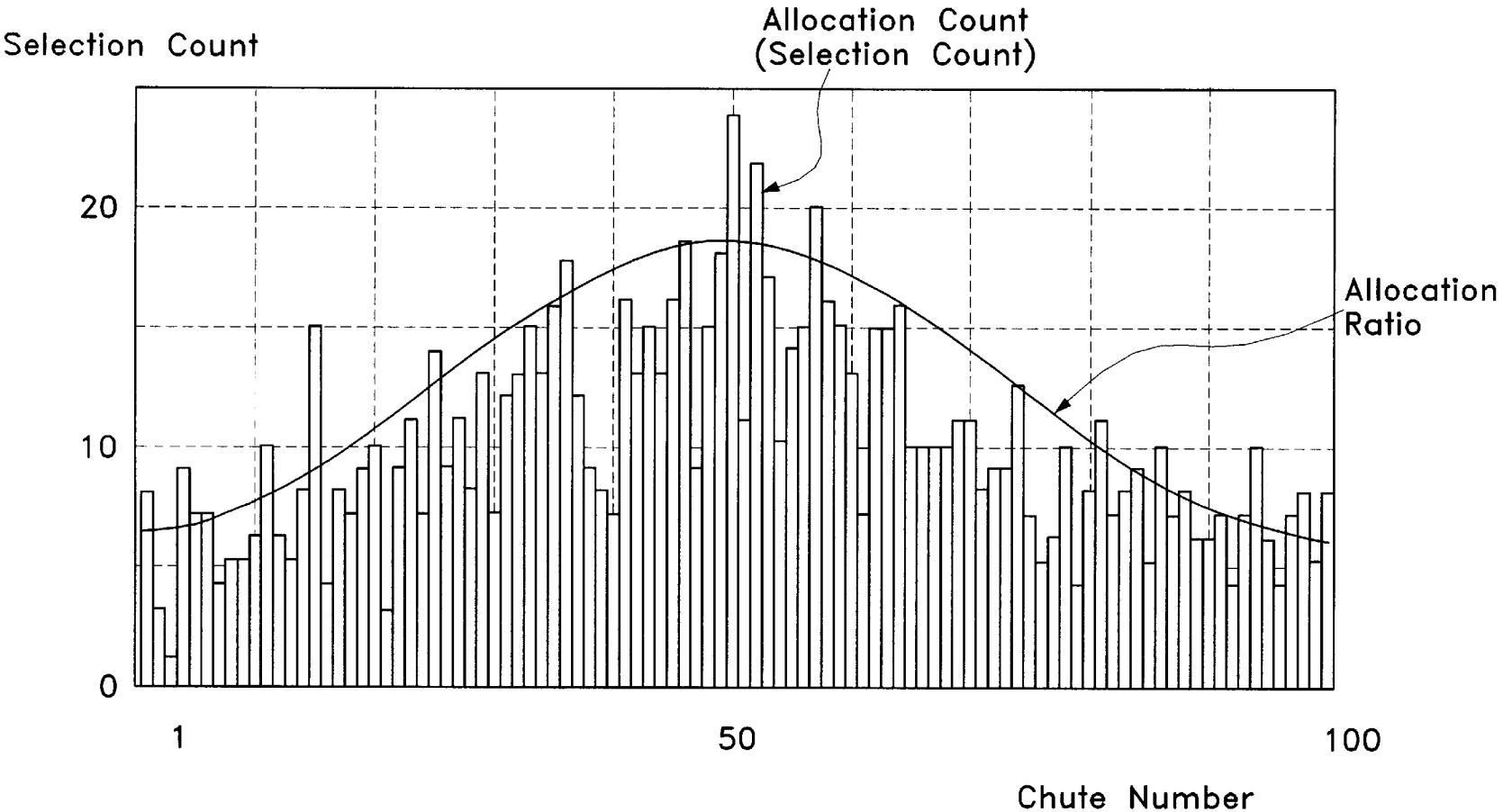
FIG. 5 is a graph showing the results of employing a weighted random number calculation process to select a chute number in the sorting system according to the second embodiment of the present invention.

FIG. 3 is a conceptual view of the sorting system according to the second embodiment of the present invention. The sorting system employs a weighted random number calculation means as the calculation means. In FIG. 3, a weighted random number calculation means 8 is a means for calculating the weights to be assigned to random numbers according to an allocation ratio. The other parts of the sorting system are the same as those in the first embodiment. FIG. 4 is a conceptual diagram showing an article identification means and the details of a controller. In FIG. 4, a normal random number generating calculation means 9 is a means of generating normal random numbers. FIG. 5 is a graph that shows the results of selecting chute numbers using the weighted random calculation process.

The operation of the sorting system according to the second embodiment of the present invention constructed as shown above will now be explained. The sorting system shown in FIG. 3 employs a weighted random number calculation means as the calculation means. This sorting system further has an article identification device 1, a sorter 2 having multiple chutes 4, and a controller 3. The controller 3 is comprised of an allocation ratio table 7 and a weighted random calculation means 8. With the allocation ratio table 7, an allocation ratio is selected based on the identification information from the article identification means 1. Chute selection information for the sorter 2 is obtained with the weighted random number calculation means 8 based upon the allocation ratio. The operation of the sorting system according to the second embodiment is generally identical to that of the first embodiment shown in FIG. 1. A detailed description will therefore be omitted, and the special feature of this embodiment, the process of weighted random number calculation, will be described.

Referring now to FIG. 4, the process of weighted random number calculation will be explained. In FIG. 4, M, N, O . . . indicate article groups. M1, M2, N1, N2, O1, O2 . . . indicate the allocation ratio integers for various article groups with respect to various chute numbers. $S_x$ indicates the cumulative sum of the allocation ratios for a selected article group up to and including chute x. Thus, the allocation ratio for chute x alone will be $S_x$–$S_{x-1}$. Controller 3 has an allocation ratio table 7 and a weighted random number calculation means 8. The allocation ratio table 7 has allocation ratios (M1, M2 . . . , N1, N2 . . . , O1, O2 . . . ) for various chutes for various article groups (M, N, O, . . . ). The allocation ratios for the articles (N1, N2, . . . in FIG. 4) are selected based on the article identification information that is output by the article identification device 1, and is provided to the weighted random number means 8.

The weighted random number calculation means 8 is composed of a normal random number generator 9 and a weighted calculation means 10. The normal random number generator 9 generates arbitrary random numbers that are uniformly distributed between 0 and the sum of the allocation ratio integers ($S_x$ at the highest chute number, i.e., the highest value of x), and provides them for weighted calculation. The weighted calculation means 10 assigns the random numbers provided by the normal random number generator 9 to the individual chutes. In the actual calculation, the chute number x is selected when the random number is in the range $S_x$–$S_{x-1}$ is selected. In this type of selection, the chute number x is selected with a probability that corresponds to the allocation ratio assigned to that chute, i.e., the weighted random number.

Referring now to FIG. 5, the results of employing the weighted random number calculation process to select chute numbers will now be described. In FIG. 5, the horizontal axis shows chute numbers, and indicates that there are 100 chutes numbered between 1 and 100. The vertical axis shows the number of times each chute was selected, and the number of hits for each chute is shown as a bar graph in the vertical direction. In addition, the allocation ratio for each chute is given using a trigonometric function. The allocation ratio for the x-th chute is set as $$\{12.5+8.5 \sin (\pi\cdot(x-25)/50)\}/12.5.$$

The total number of articles entered into the system depicted by the graph shown in FIG. 5 is 1,000. The simple arithmetical average number of hits is 10. Because the allocation ratio shown therein has been multiplied by 12.5 (the number of times a chute was selected), the allocation ratio shown in the figure is set such that it is fits within 25 for the number of times a chute was selected. In the graph shown in FIG. 5, the number of times each chute was selected indicates a distribution that follows the allocation ratio. One can see that the sorting system shown in FIG. 3 can achieve sorting that basically corresponds to a predetermined allocation ratio.

As described above, in the second embodiment of the present invention, because the sorting system is constructed such that it identifies the articles returned from retail stores, selects an allocation ratio from the allocation ratio table, calculates the weights to be assigned to random numbers according to the allocation ratio, and sorts the articles into special-event sale articles and special sale articles using a sorter having multiple chutes, sorting that basically corresponds to a predetermined allocation ratio can be achieved.

Third Embodiment

A third embodiment of the present invention is a sorting system that identifies the articles returned from retail stores, selects an allocation ratio from an allocation ratio table, calculates the weights to be assigned to random numbers according to the allocation ratio, reduces the deviation of the weighted random number calculation, and based on these results, sorts the articles into special-event sale articles and special sale articles using a sorter having multiple chutes.

Figure 6:
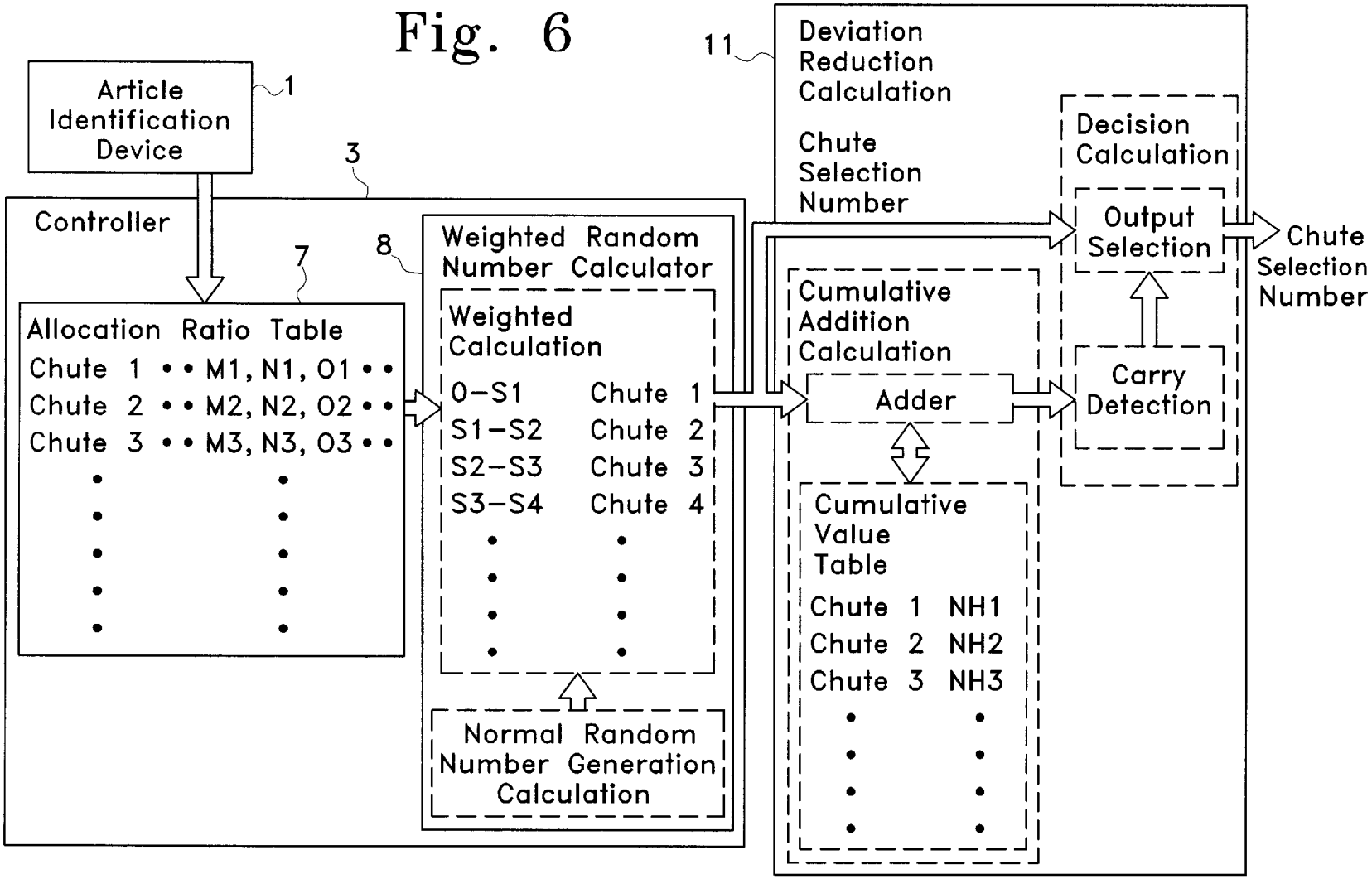
FIG. 6 is a conceptual diagram of the calculation device that is employed in the sorting system according to the third embodiment of the present invention.
Figure 7:
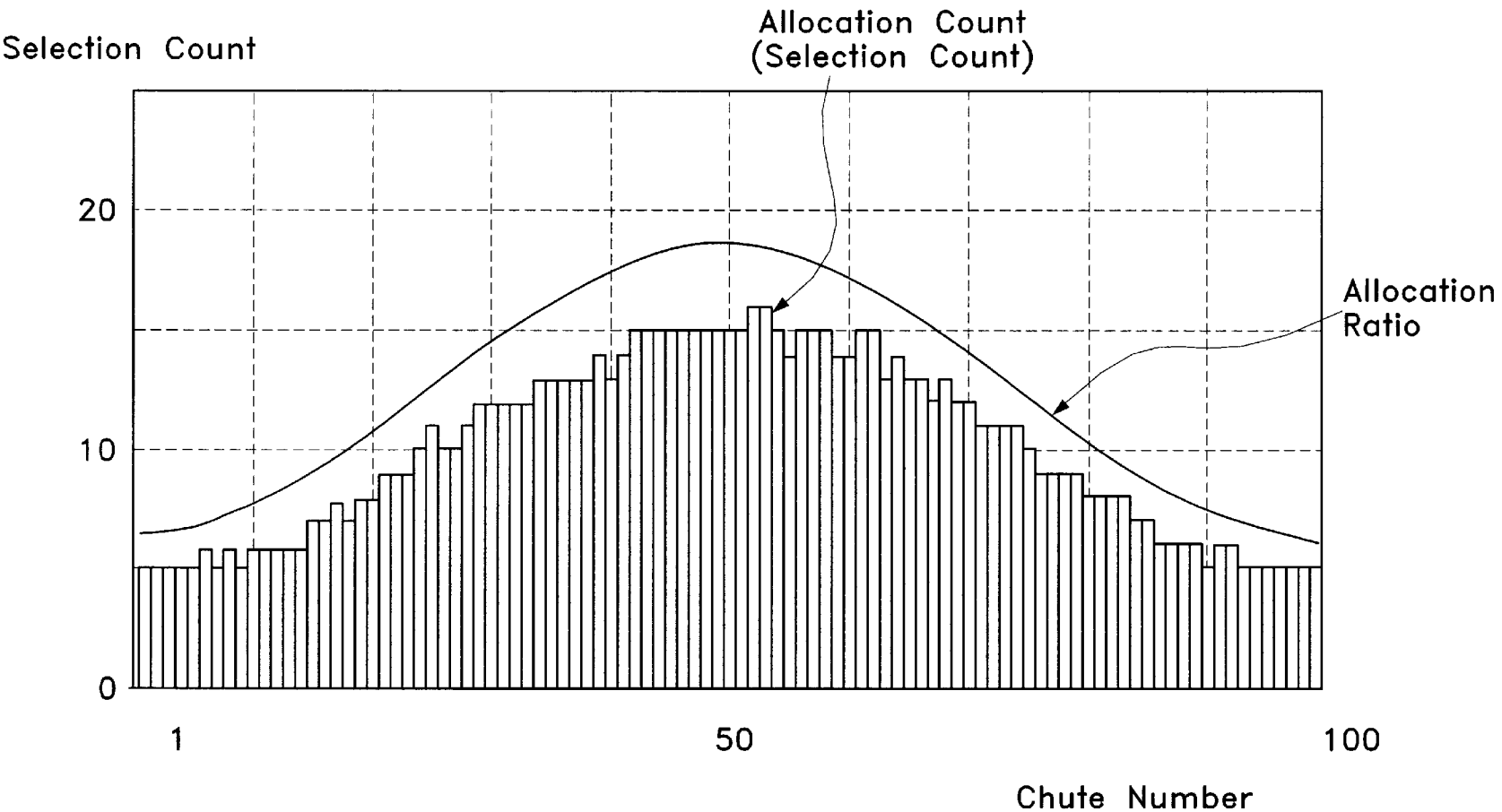
FIG. 7 is a graph showing the chute selection results from the calculation device of the sorting system according to the third embodiment of the present invention.

FIG. 6 is a conceptual diagram of the calculation device that is employed in the sorting system according to the third embodiment of the present invention. In FIG. 6, a deviation reduction calculation means 11 is a means for reducing the deviation of the weighted random number calculation. The other parts of the third embodiment are the same as those in the second embodiment. FIG. 7 is a graph that shows the chute selection results.

The operation of the sorting system according to the third embodiment of the present invention constructed in the aforementioned manner will now be described. The generation of the normal random number is accompanied by a variance. As a result, the number of times each chute is selected is accompanied by some deviation. When an allocation ratio is provided by means of a continuous function, adjacent chutes are supposed to have smoothly continuous selection counts. The graph of the operational results of the second embodiment shown in FIG. 5 shows many instances in which the selection counts are more or less discontinuous. By applying a means for reducing the deviation of the weighted random number calculation to this distribution, effective results can be demonstrated.

Referring now to FIG. 6, the calculation device employed in the sorting system according to the third embodiment will now be described. The calculation means shown in FIG. 6 has an allocation ratio table 7, a weighted random number calculating means, and a deviation reduction calculation means 11. Based upon the article identification information that is output from an article identification device 1, the allocation ratio table 7 selects the allocation ratio for each chute, and provides it to the weighted random number calculation means 8. The weighted random number calculation means 8 applies the allocation ratio from the allocation ratio table 7 to the normal random number generated by a normal random number generator 9, and provides it to the deviation reduction calculation means 11 together with the selected chute number. The deviation reduction calculation means 11 has a cumulative addition calculation means and a decision calculation means. The cumulative addition calculation means has an adder and a cumulative value table. The decision calculation means is constructed from a carry detection means and an output selection means.

In the calculation means shown in FIG. 6, the process in which the weighted random number calculation means 8 provides the primary chute selection number (before deviation reduction) for the identified article to the deviation reduction calculation means has already been explained, and thus its explanation will be omitted. Here, only the deviation reduction calculation will be described in detail. Based on the primary chute selection number provided by the deviation reduction calculation means 11, the cumulative addition calculation means extracts the cumulative value on which cumulative calculation is to be performed from the cumulative value table, adds the value "1" to this, and returns it.

In FIG. 6, the number of times a chute X is selected for article group N has been selected is expressed as NHx. For the cumulative addition calculation, the following is carried out:

$NHx := NHx + 1$ thereby adding to the cumulative total the number of times the chute X for article group N has been selected. At the same time, the result of this addition is provided to the decision calculation means. The decision calculation means determines whether or not this cumulative addition has resulted in a carry detection. If a carry has occurred, the chute number is provided as a calculation device output to the sorter by means of the output selection means.

In the calculation device of FIG. 6, a single chute selection number might not necessarily be obtained in a single calculation. In other words, the chute number cannot be obtained until a carry occurs in the cumulative value, and weighted random number generation will be repeatedly carried out. As a consequence, a chute number will be obtained as an average value of multiple generated random numbers. In other words, if carry detection occurs at the 10's and 100's places, a larger number of averages can be obtained. The chute selection results will have an extremely small, i.e., reduced, deviation.

The graph in FIG. 7 shows the chute selection results from the calculation device shown in FIG. 6. On the whole, this graph is the same as the graph of the results shown in FIG. 5, and thus a detailed description will be omitted. This graph uses a carry at the 100's place to determine whether a carry has occurred in the deviation reduction calculation.

As is clear from the graph in FIG. 7, the deviation reduction calculation has produced an allocation result with an extremely small variance (deviation). Note also that in this example, average value acquisition using cumulative addition as the deviation reduction calculation was explained. However, it is also possible to obtain the average value using other deviation reduction calculations.

As described above, in the third embodiment of the present invention, because the sorting system is constructed such that it identifies articles returned from retail stores, selects an allocation ratio from the allocation ratio table, calculates the weights to be assigned to random numbers according to the allocation ratio, reduces the deviation of the weighted random number calculation, and based on this result, sorts the articles into special-event sale articles and special sale articles using a sorter having multiple chutes, an allocation result with an extremely small variance (deviation) can be obtained.

What is claimed is:

1. A sorting system comprising:

an article identification device for outputting identification information for each article being sorted, a sorter having multiple chutes, and a controller responsive to said article identification device for providing chute selection information to said sorter; said controller further comprising:

an allocation ratio table, including for each possible type of article to be sorted a respective predetermined allocation ratio among multiple predetermined possible destinations for that type of article, selection means for selecting a particular said predetermined allocation ratio from said allocation ratio table based upon the identification information output by the article identification device for the article being sorted, and calculation means for calculating said chute selection information based at least in part upon the selected predetermined allocation ratio, wherein the predetermined allocation ratios are independent of the types and quantities of the articles actually available for sorting.

2. The sorting system according to claim 1, wherein the calculation means further comprises means for generating a respective random number for each article being sorted and the calculation of the chute selection information is a weighted calculation based on both said predetermined allocation ratio and said respective random number that maintains the predetermined allocation ratios as additional articles are received and sorted.

3. The sorting system according to claim 2, wherein the calculation means further comprises means for reducing the deviation of the results of the weighted calculation.

4. The sorting system according to claim 3, wherein the deviation reduction calculation means further comprises cumulative addition calculation means that accumulates and retains the results of said weighted calculation, and decision calculation means that determines when the results accumulated by the cumulative addition calculation means has reached a value within a predetermined interval.

5. The sorting system according to claim 1, wherein said article identification device is capable of identifying items returned from retail stores.

6. The sorting system according to claim 1, wherein said article identification device is capable of identifying special-event sale items.

7. The sorting system according to claim 1, wherein said article identification device is capable of identifying special sale items.

* * * * *